US007096535B2

(12) United States Patent
Lin

(10) Patent No.: US 7,096,535 B2
(45) Date of Patent: Aug. 29, 2006

(54) HINGE DEVICE

(76) Inventor: Ming-Jeng Lin, No. 122, Lane 634, Kung-Yuan Rd., Tainan City (TW)

( * ) Notice: Subject to any disclaimer, the term of this patent is extended or adjusted under 35 U.S.C. 154(b) by 40 days.

(21) Appl. No.: 10/758,708

(22) Filed: Jan. 16, 2004

(65) Prior Publication Data

US 2005/0155180 A1 Jul. 21, 2005

(51) Int. Cl.
*E05F 1/08* (2006.01)

(52) U.S. Cl. ..... 16/287; 16/286; 16/54; 16/50

(58) Field of Classification Search ..... 16/50, 16/68, 232, 293, 294, 297, 302, 327, 333, 16/343, 286, 287, 281, 54
See application file for complete search history.

(56) References Cited

U.S. PATENT DOCUMENTS 4,075,735 A * 2/1978 Rock et al. ..... 16/278
4,251,900 A * 2/1981 Lautenschlager ..... 16/294
4,449,269 A * 5/1984 Sundermeier et al. ..... 16/50
4,543,686 A * 10/1985 Rock et al. ..... 16/288
6,684,453 B1 * 2/2004 Wang ..... 16/54
6,859,979 B1 * 3/2005 Egger et al. ..... 16/327

* cited by examiner

*Primary Examiner*—Chuck Y. Mah
*Assistant Examiner*—Michael J. Kyle
(74) *Attorney, Agent, or Firm*—Brinks Hofer Gilson & Lione

(57) ABSTRACT

A hinge device includes a frame bracket adapted to be secured to a door frame, a door bracket adapted to be secured to a door panel, first and second links pivoted to the frame bracket and the door bracket, an urging member for urging the door panel to move from an opened position toward a closed position relative to the door frame, and a damping member adapted to be secured to the door frame and connected movably to the second link through a transmission link so as to damp pivoting movement of the door panel relative to the door frame.

2 Claims, 8 Drawing Sheets

HINGE DEVICE

BACKGROUND OF THE INVENTION

1. Field of the Invention

This invention relates to a hinge device, more particularly to a hinge device with a damping member for damping pivoting movement of a door panel relative to a door frame.

2. Description of the Related Art

FIGS. 1 to 3 illustrate a conventional hinge device that includes a door bracket 14 secured to a door panel 11, and a frame bracket 13 pivoted to the door bracket 14 and secured to a door frame 12 so as to permit pivoting movement of the door panel 11 relative the door frame 12. The hinge device further includes a first link 21 pivoted to the door bracket 14 through a first pivot pin 26 and to the frame bracket 13 through a second pivot pin 24, a second link 22 pivoted to the door bracket 14 through a third pivot pin 27 and to the frame bracket 13 through a fourth pivot pin 25, and a torsion spring 23 sleeved around the second pivot pin 24 and having a first end 231 secured to the frame bracket 13, and a second end 232 extending toward the second link 22. The second link 22 is formed with a driving protrusion 223 that protrudes therefrom and that abuts against the second end 232 of the torsion spring 23 so as to move the second end 232 of the torsion spring 23 toward the first end 231 of the torsion spring 23 when the door panel 11 is pivoted relative to the door frame 12 from the closed position toward the opened position, thereby accumulating a restoring force for restoring the door panel 11 to the closed position.

The conventional hinge device is disadvantageous in that since the door panel 11 is urged by the torsion spring 23, slamming of the door panel 11 tends to occur during closing of the same.

SUMMARY OF THE INVENTION

Therefore, the object of the present invention is to provide a hinge device that is capable of overcoming the aforesaid drawback of the prior art.

According to the present invention, there is provided a hinge device that is adapted to connect a door panel to a door frame and that includes: a frame bracket adapted to be secured to the door frame; a door bracket adapted to be secured to the door panel; spaced apart first and second links, each of which is pivoted to the frame bracket and the door bracket so as to permit pivoting movement of the door panel together with the first and second links relative to the door frame, the second link having a pivot end that is pivoted to the frame bracket and being formed with a lever member that protrudes from the pivot end; an urging member for urging the door panel to move from an opened position toward a closed position relative to the door frame; a damping member adapted to be secured to the door frame and connected movably to the second link so as to damp pivoting movement of the door panel relative to the door frame, the damping member including a hydraulic cylinder that has a cylinder body secured to the frame bracket, and a piston rod extending movably into the cylinder body; and a transmission link that is pivoted to the lever member and the piston rod of the damping member so as to connect the second link to the damping member. The transmission link and the lever member define cooperatively an angle of less than 180 degrees therebetween.

BRIEF DESCRIPTION OF THE DRAWINGS

In drawings which illustrate embodiments of the invention.

DETAILED DESCRIPTION OF THE PREFERRED EMBODIMENTS

Figure 1:
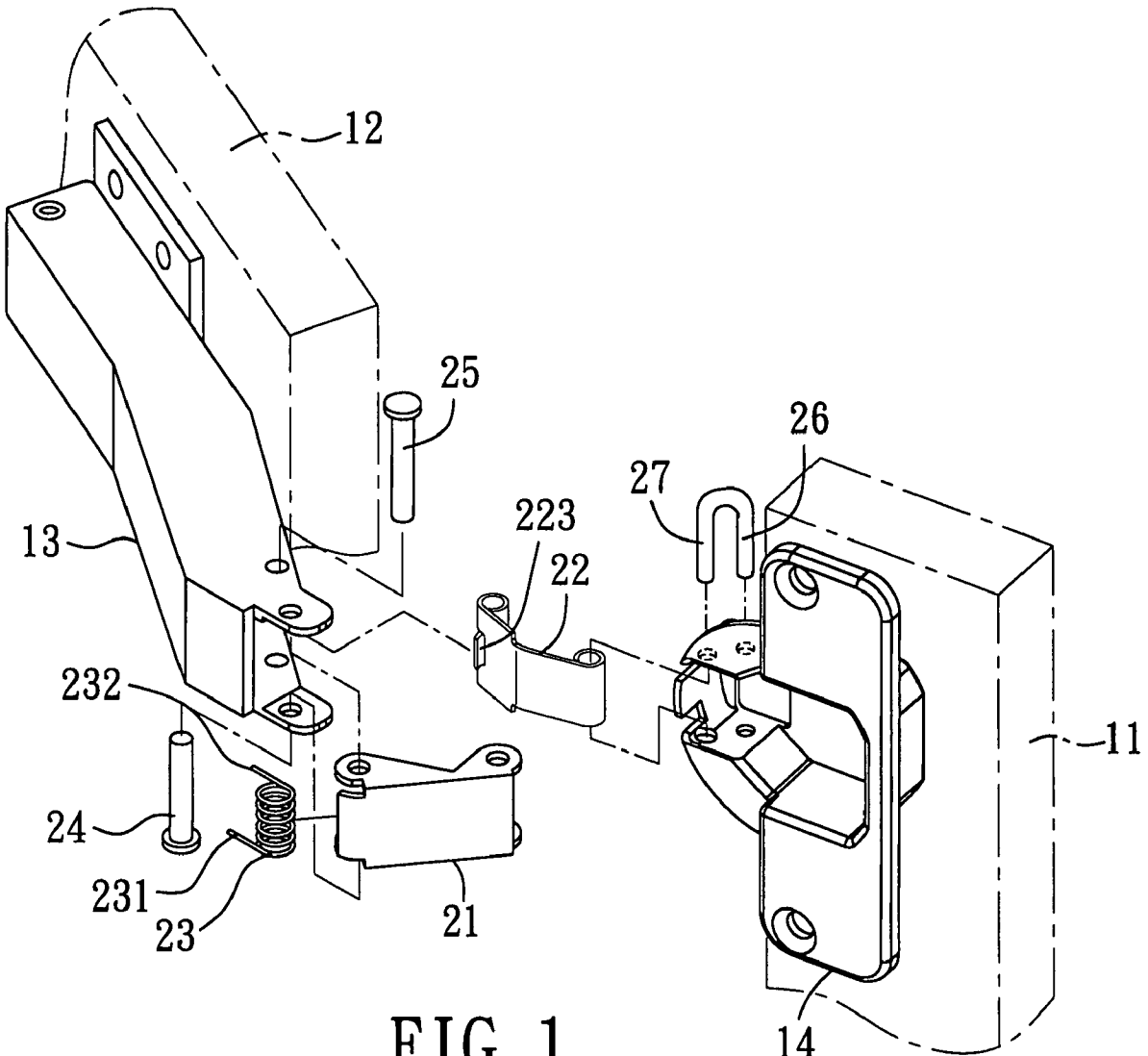
FIG. 1 PRIOR ART
FIG. 1 is an exploded perspective view of a conventional hinge device that is used to connect a door panel to a door frame.
Figure 2:
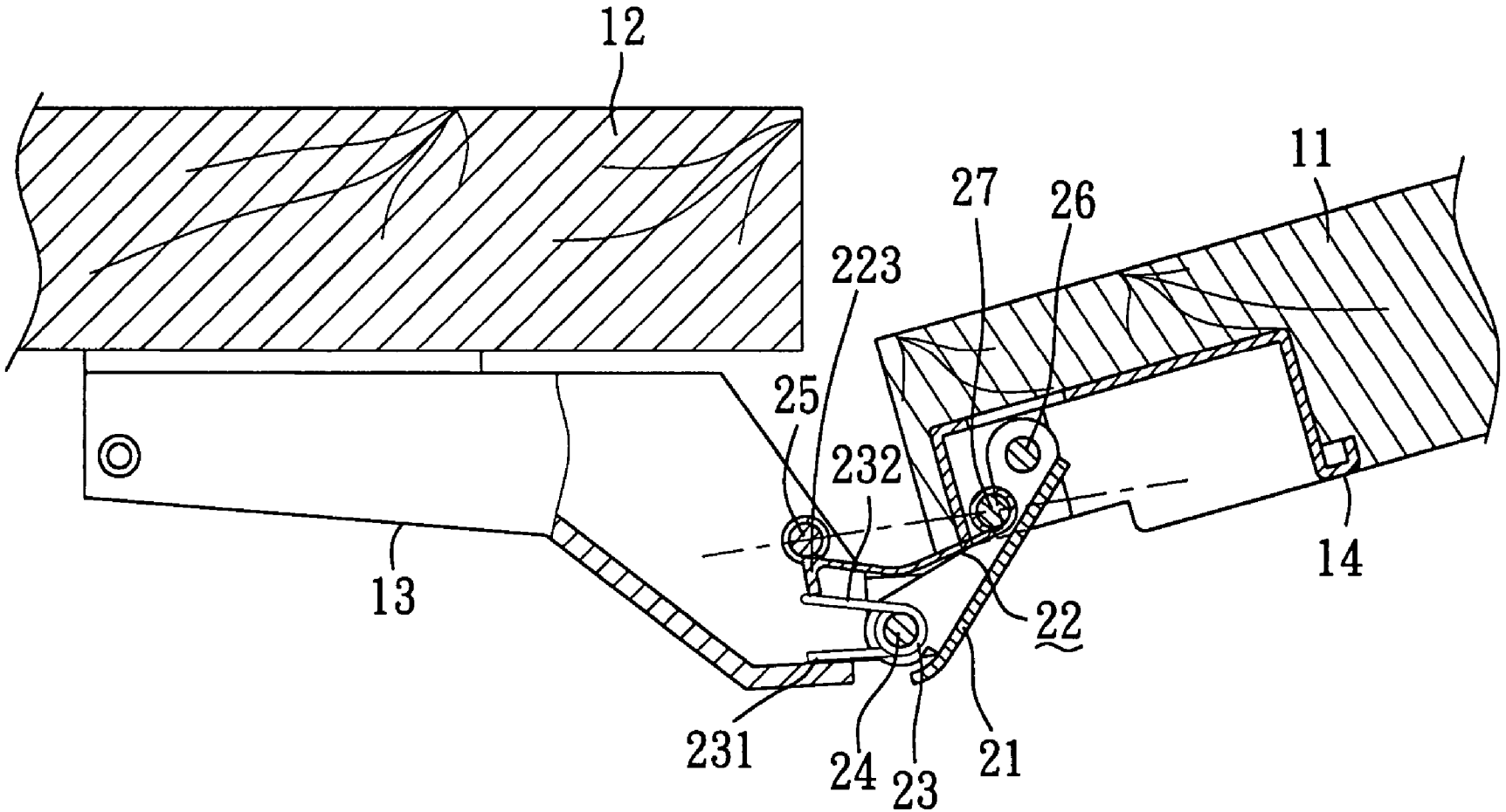
FIG. 2 PRIOR ART
FIG. 2 is a sectional view of the conventional hinge device, with the door panel disposed at an opened position.
Figure 3:
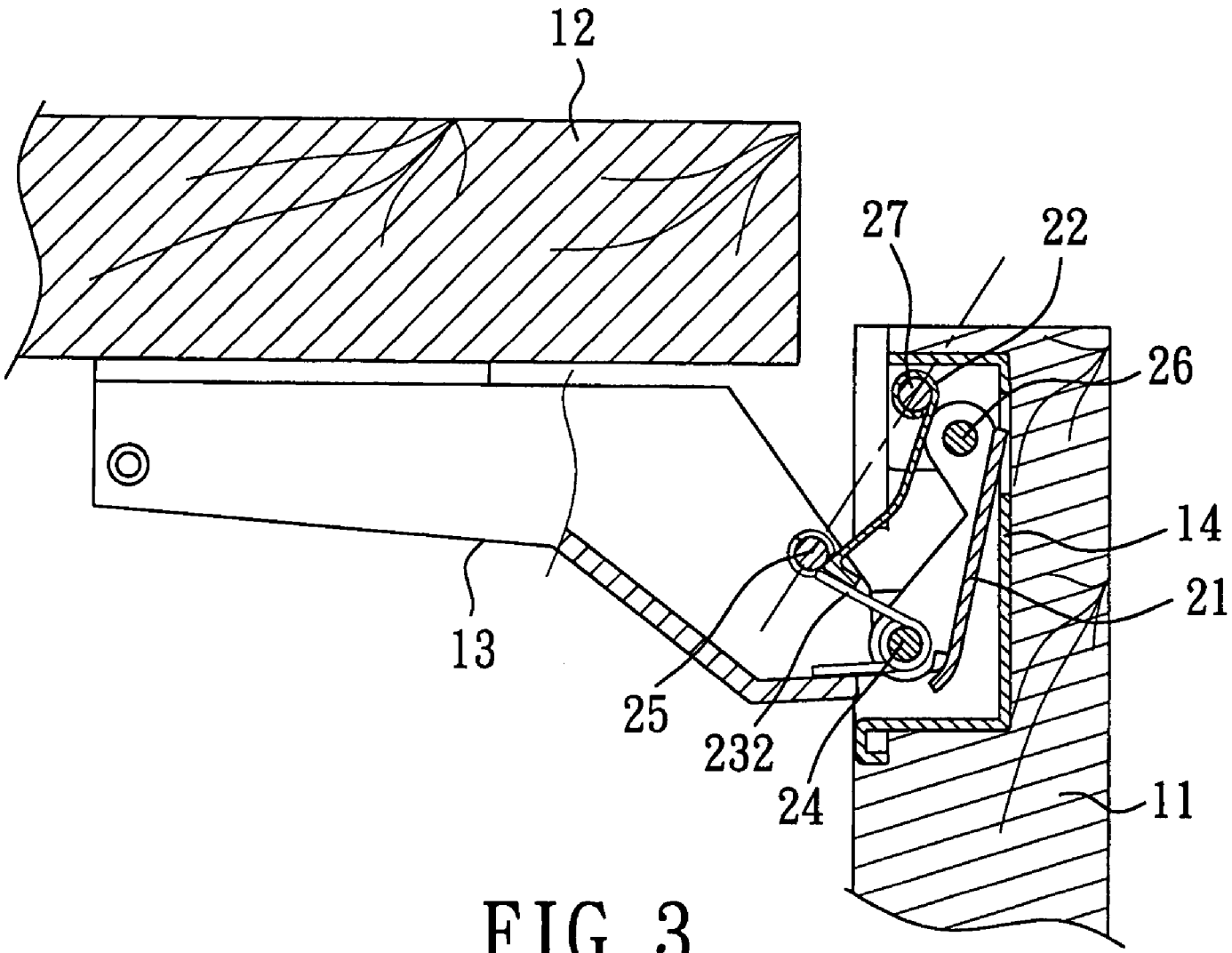
FIG. 3 PRIOR ART
FIG. 3 is a sectional view of the conventional hinge device, with the door panel disposed at a closed position.
Figure 4:
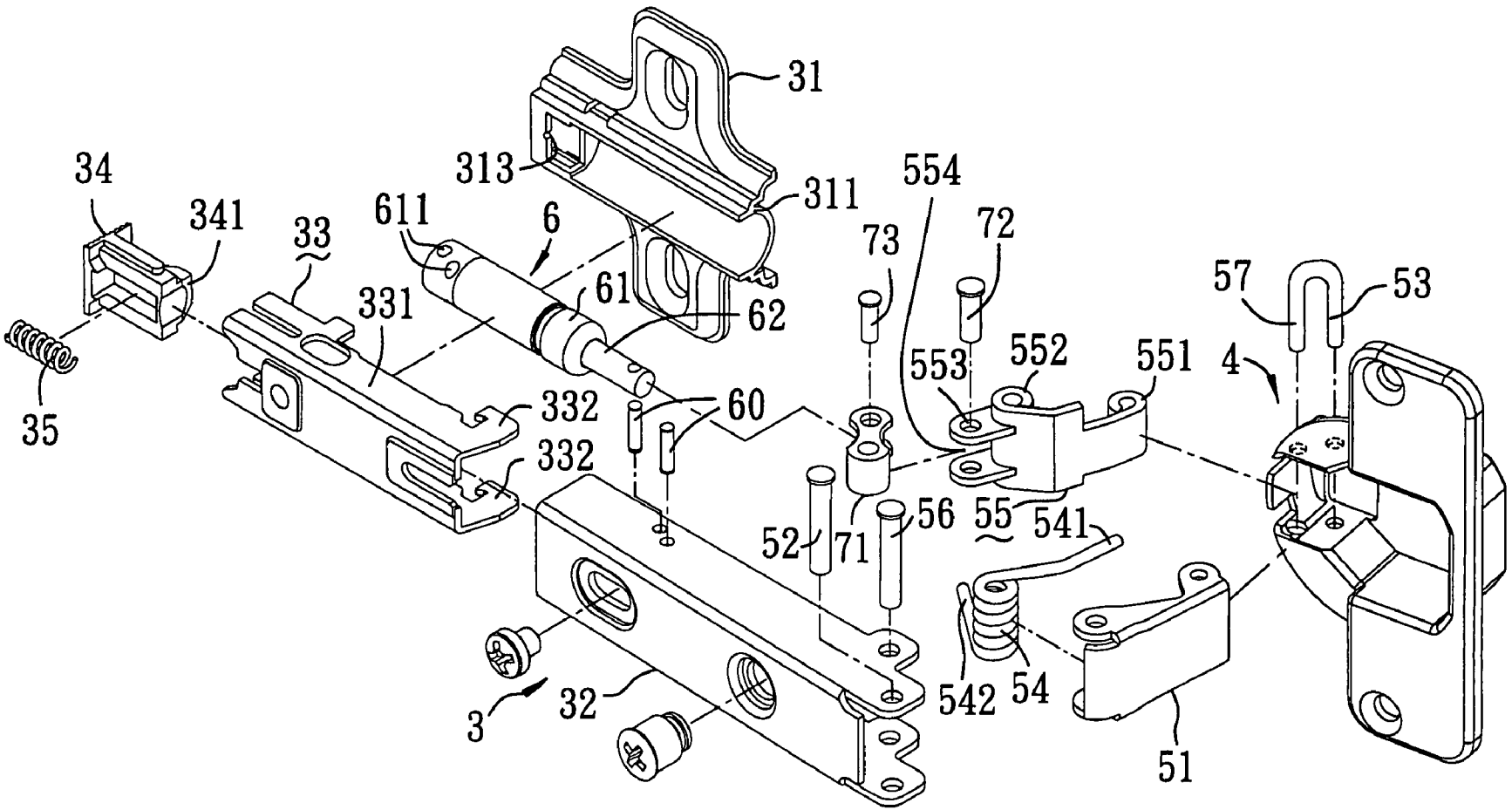
FIG. 4 is an exploded perspective view of the first preferred embodiment of a hinge device according to the present invention, which is adapted to connect a door panel to a door frame.
Figure 5:
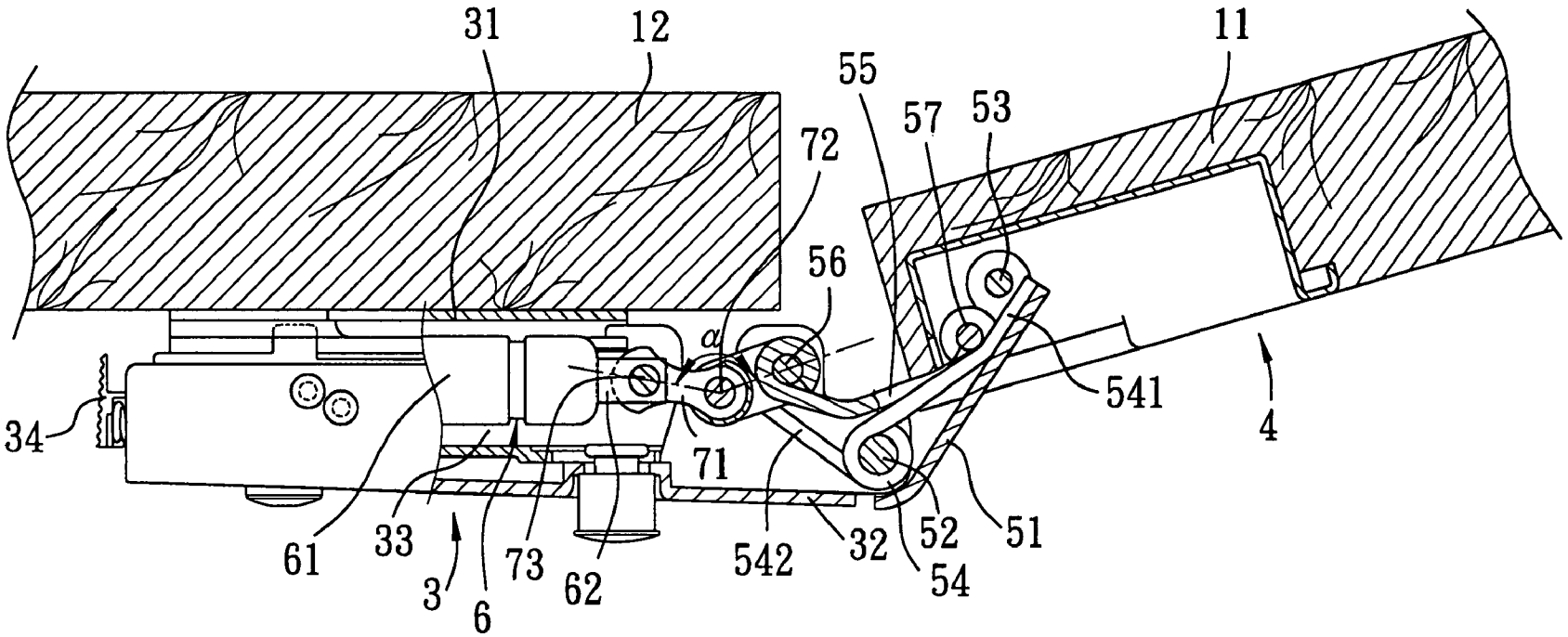
FIG. 5 is a sectional view of the first embodiment, with the door panel disposed at an opened position.
Figure 6:
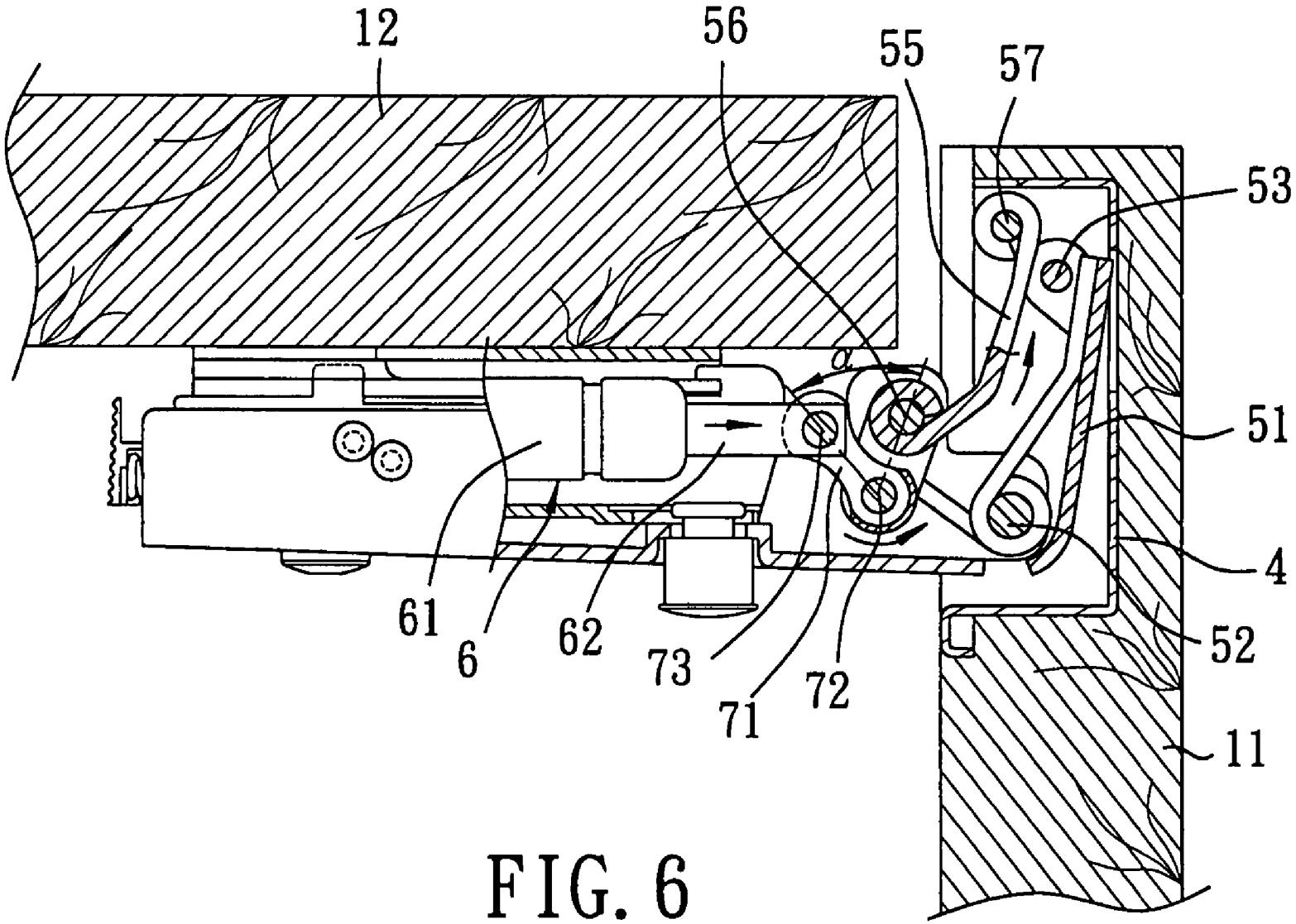
FIG. 6 is a sectional view of the first embodiment, with the door panel disposed at a closed position.

FIGS. 4 to 6 illustrate the first preferred embodiment of a hinge device according to the present invention, which is adapted to connect a door panel 11 to a door frame 12.

The hinge device includes: a frame bracket 3 adapted to be secured to the door frame 12; a door bracket 4 adapted to be secured to the door panel 11; spaced apart first and second links 51, 55, the first link 51 being pivoted to the frame bracket 3 through a pivot pin 52 and to the door bracket 4 through a pivot pin 53, the second link 55 being pivoted to the frame bracket 3 through a pivot pin 56 and to the door bracket 4 through a pivot pin 57 (which is connected to the pivot pin 53 to form a U-shaped rod), the first and second links 51, 55 permitting pivoting movement of the door panel 11 together with the first and second links 51, 55 relative to the door frame 12; an urging member 54 for urging the door panel 11 to move from an opened position (see FIG. 5) toward a closed position (see FIG. 6) relative to the door frame 12; and a damping member 6 adapted to be secured to the door frame 12 and connected movably to the second link 55 so as to damp pivoting movement of the door panel 11 relative to the door frame 12, thereby preventing undesired slamming of the door panel 11 during closing of the same.

In this embodiment, the second link 55 has a first pivot end 551 that is pivoted to the door bracket 4 through the pivot pin 57, and a second pivot end 552 that is opposite to the first pivot end 551 and that is pivoted to the frame bracket 3 through the pivot pin 56. The second link 55 is formed with a lever member 553 that includes a pair of ears protruding from the second pivot end 552. The hinge device further includes a transmission link 71 that is pivoted to the lever member 553 through a pivot pin 72 and to the damping member 6 through a pivot pin 73 so as to permit connection of the second link 55 to the damping member 6.

The damping member 6 includes a hydraulic cylinder that has a cylinder body 61 secured to the frame bracket 3, and a piston rod 62 extending movably into the cylinder body 61 and pivoted to the transmission link 71 through the pivot pin 73. The transmission link 71 and the lever member 553 define cooperatively an angle ($\alpha$) of less than 180 degrees therebetween so as to facilitate co-movement of the piston rod 62 and the first and second links 51, 55 when the first and second links 51, 55 are pivoted relative to the frame bracket 3.

The pivot pin 72 cooperates with the second pivot end 552 of the second link 55 to define a gap 554 therebetween. The urging member 54 includes a torsion spring sleeved around the first pivot pin 52 and having a first end 541 that is secured to the first link 51 so as to be co-movable therewith, and a second end 542 that extends into and that is limited within the gap 554. The first end 541 of the torsion spring 54 moves together with the first link 51 away from the second end 542 of the torsion spring 54 upon pivoting movement of the door panel 11 to the opened position relative to the door frame 12 and toward the second end 542 of the torsion spring 54 upon pivoting movement of the door panel 11 to the closed position relative to the door frame 12.

The frame bracket 3 includes a fixed plate 31 that is adapted to be secured to the door frame 12 and that defines two engaging recesses 311, an elongated U-shaped inner mounting piece 33 that is formed with two hooked protrusions 332 engaging respectively the engaging recesses 311 in the fixed plate 31 and that defines an inner space for receiving the damping member 6 therein, and an elongated U-shaped outer mounting piece 32 that surrounds and that is secured to the inner mounting piece 33 through screw means. The pivot pins 52, 56 extend through an end of the outer mounting piece 32. The damping member 6 is secured to the frame bracket 3 through two locking pins 60 extending through the outer and inner mounting pieces 32, 33 and into recesses 611 formed in the cylinder 61 of the hydraulic cylinder. An engaging block 34 extends into the inner space in the inner mounting piece 33, is mounted movably on one end of the inner mounting piece 33 opposite to the hooked protrusions 332, and is formed with an engaging tongue 341. The engaging block 34 is urged by a coil spring 35 to permit engagement between the engaging tongue 341 and a groove 313 in one end of the fixed plate 31.

Figure 7:
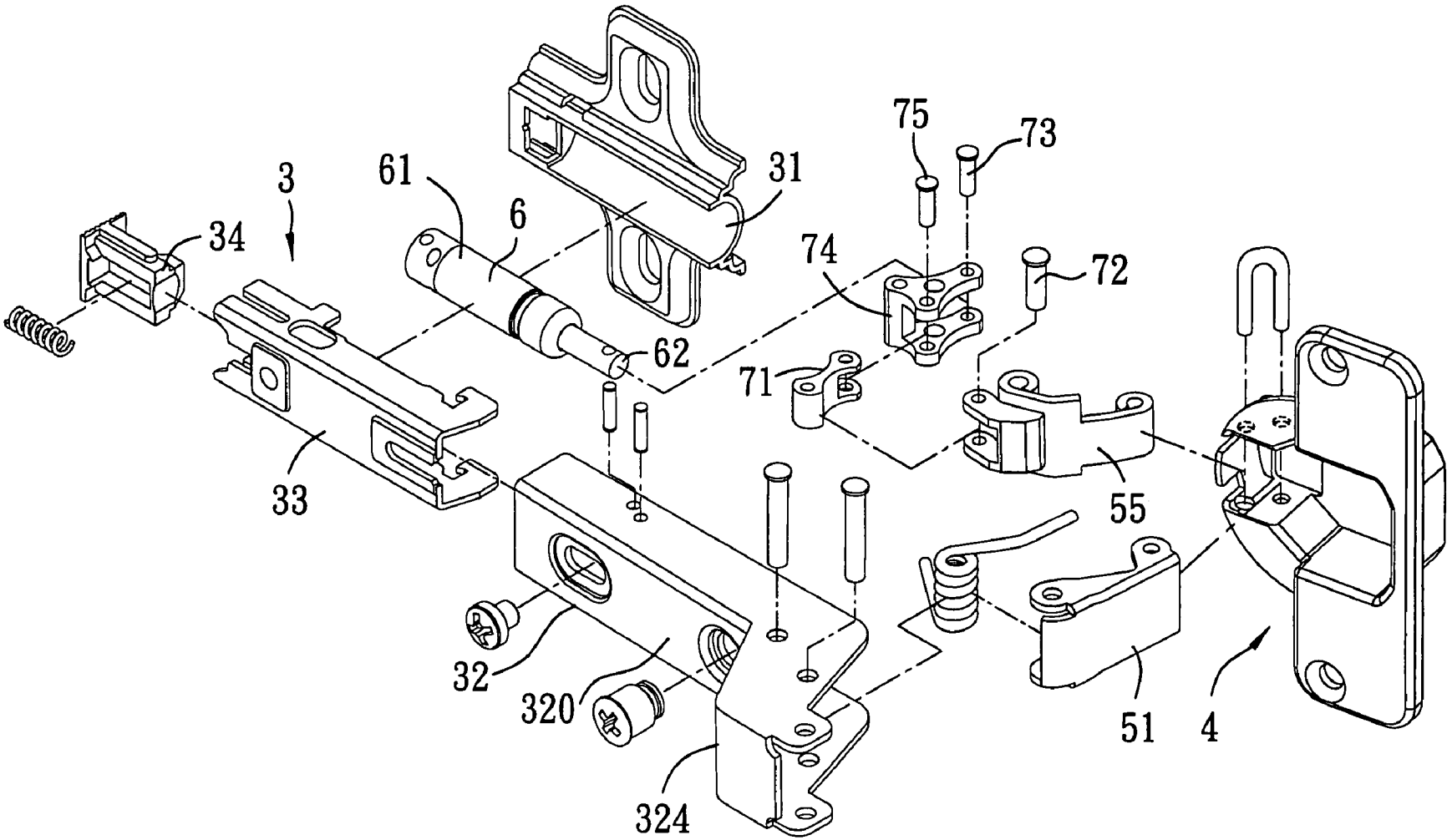
FIG. 7 is an exploded perspective view of the second preferred embodiment of the hinge device according to the present invention.
Figure 8:
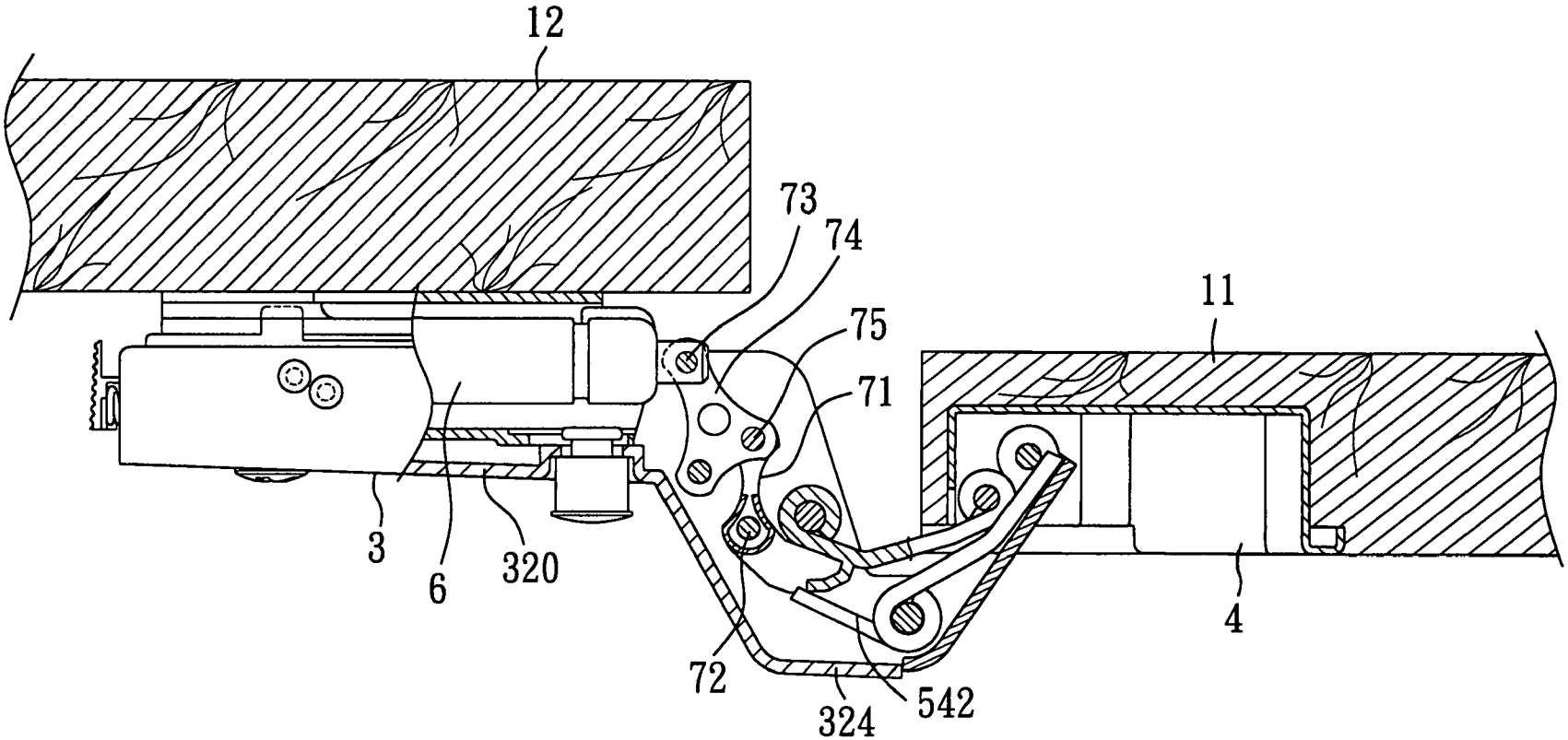
FIG. 8 is a sectional view of the second embodiment, with the door panel disposed at the opened position.

FIGS. 7 and 8 illustrate the second preferred embodiment of the hinge device according to the present invention. The hinge device of this embodiment is similar to the previous embodiment, except that the outer mounting piece 32 has a straight section 320 and an end section 324 extending inclinedly from the straight section 320 and that a second transmission link 74 is provided and is pivoted to the frame bracket 3, the first transmission link 71, and the damping member 6 so as to accommodate a different construction of the door panel 11 when at the opened position relative to the door frame 12 as compared to that of the previous embodiment. In addition, with the inclusion of the second transmission link 74 in the hinge device of this invention, linear movement of the piston rod 62 can be ensured.

With the inclusion of the damping member 6, the aforesaid drawback associated with the prior art can be eliminated.

With the invention thus explained, it is apparent that various modifications and variations can be made without departing from the spirit of the present invention.

I claim:

1. A hinge device adapted to connect a door panel to a door frame, comprising:

a frame bracket adapted to be secured to the door frame;

a door bracket adapted to be secured to the door panel;

spaced apart first and second links, each of which is pivoted to said frame bracket and said door bracket so as to permit pivoting movement of the door panel together with said first and second links relative to the door frame, said second link having a pivot end that is pivoted to said frame bracket and being formed with a lever member that protrudes from said pivot end;

an urging member for urging the door panel to move from an opened position toward a closed position relative to the door frame;

a damping member adapted to be secured to the door frame and connected movably to said second link so as to damp pivoting movement of the door panel relative to the door frame, said damping member including a hydraulic cylinder that has a cylinder body secured to said frame bracket, and a piston rod extending movably into said cylinder body;

a first transmission link that is pivoted to said lever member and said piston rod of said damping member so as to connect said second link to said damping member, said first transmission link and said lever member defining cooperatively an angle of less than 180 degrees therebetween; and two pivot pins, said first link being pivoted to said frame bracket through one of said pivot pins, said first transmission link being pivoted to said lever member through the other of said pivot pins, the other of said pivot pins cooperating with said pivot end of said second link to define a gap therebetween, said urging member including a torsion spring sleeved around said one of said pivot pins and having a first end that is secured to said first link, and a second end that extends into and that is limited within said gap so as to permit movement of said first end of said torsion spring relative to said second end of said torsion spring upon pivoting movement of the door panel relative to the door frame.

2. The hinge device of claim 1, further comprising a second transmission link that is pivoted to said frame bracket, said first transmission link, and said damping member.

* * * * *